United States Patent [19]

Godyak

[11] Patent Number: 4,987,342

[45] Date of Patent: Jan. 22, 1991

[54] SELF-BALLASTED GLOW DISCHARGE LAMP HAVING INDIRECTLY-HEATED CATHODE

[75] Inventor: Valery Godyak, Andover, Mass.

[73] Assignee: GTE Products Corporation, Danvers, Mass.

[21] Appl. No.: 328,994

[22] Filed: Mar. 27, 1989

[51] Int. Cl.[5] ..... H01J 61/12; H01J 61/56; H05B 41/18

[52] U.S. Cl. ..... 315/49; 315/94; 313/619

[58] Field of Search ..... 315/49, 50, 58, 94; 313/619

[56] References Cited

U.S. PATENT DOCUMENTS

| | | | |
|---|---|---|---|
| 2,020,736 | 11/1935 | Pirani et al. | 315/49 |
| 2,024,529 | 12/1935 | Kouvallis | 315/49 |
| 2,099,111 | 11/1937 | Hefele | 315/94 |
| 2,108,537 | 2/1938 | Lederer | 315/94 X |
| 2,135,714 | 11/1938 | Juman | 315/49 X |
| 2,200,951 | 5/1940 | Elenbaas | 315/49 |
| 2,295,043 | 9/1942 | Lompe et al. | 315/49 |
| 2,495,580 | 1/1950 | Gall | 315/94 |
| 2,507,696 | 5/1950 | Depp | 313/619 X |
| 3,243,632 | 3/1966 | White | 315/49 X |
| 3,349,282 | 10/1967 | Krieger | 315/94 |
| 3,836,816 | 9/1974 | Heck | 315/94 |
| 3,968,396 | 7/1976 | Clune et al. | 315/49 X |
| 4,268,780 | 5/1981 | Roche et al. | 315/49 X |
| 4,316,124 | 2/1982 | Verwimp et al. | 315/49 X |

*Primary Examiner*—Eugene R. LaRoche
*Assistant Examiner*—Do Hyun Yoo
*Attorney, Agent, or Firm*—Carlo S. Bessone

[57] ABSTRACT

A negative glow discharge lamp including an anode and an indirectly-heated cathode disposed within a phosphor-coated envelope. The cathode includes a heater filament surrounded by a metallic cylinder which is coated with an emissive material. The differential resistance of the heater filament is sufficient to internally ballast the flow discharge lamp.

5 Claims, 2 Drawing Sheets

SELF-BALLASTED GLOW DISCHARGE LAMP HAVING INDIRECTLY-HEATED CATHODE

CROSS-REFERENCE TO A RELATED APPLICATION

This application discloses, but does not claim, inventions which are claimed in U.S. Ser. No. 07/329,135 filed concurrently herewith and assigned to the Assignee of this application.

FIELD OF THE INVENTION

This invention relates in general to electric discharge lamps and pertains, more particularly, to a negative glow discharge lamp having a wire anode.

BACKGROUND OF THE INVENTION

A negative glow discharge lamp typically is comprised of a light-transmitting envelope containing a noble gas and mercury with a phosphor coating on an inner surface of the envelope which is adapted to emit visible light upon absorption of ultraviolet radiation that occurs when the lamp is excited. The lamp is excited by means of the application of a voltage between the lamp electrodes. Current flows between the electrodes after a certain potential is applied to the electrodes, commonly referred to as the breakdown voltage. An elementary explanation of the phenomenon is that the gas between the electrodes becomes ionized at a certain voltage, conducts current, and emits ultraviolet radiation. The phosphor coating on the inner surface of the lamp envelope is caused to fluoresce and re-emit a substantial portion of the ultraviolet radiation as visible light. The spectral characteristics of the visible light is determined by the composition of the fluorescent powders used for the phosphor coating.

Negative glow discharge lamps, in common with other discharge devices, generally require a series-connected current-limiting device. The reason for this requirement is commonly given as the "negative resistance" of the discharge, a statement that implies that the discharge has its differential resistance much smaller than its static resistance (i.e., $dV/dI << V/I$).

Examples of typical glow discharge lamps are found in U.S. Pat. No. 2,341,990 to Inman et al and U.S. Pat. No. 2,403,184 to Lemmers.

Reference is now made herein to FIG. 1 which illustrates a known circuit diagram for starting and operating a typical negative glow discharge lamp. FIG. 1 illustrates a glow discharge lamp 10' including an anode A and a cathode C. The cathode C is in the form of a standard filamentary exciter coil coated with an emissive material. Continuous heater current is provided to cathode C by means of a first dc source 13. A second dc source 15 is provided and is electrically coupled to lamp 10' through a series connected external ballast, such as a resistor $R_b$.

During lamp operation, a considerable voltage drop exists on the cathode due to electrical heating. As a result, the discharge current (indicated by arrows on lamp 10') flows to the negative end of the cathode and thereby bypassing the resistance of the cathode. While the filament power goes for heating the entire cathode surface, only a small portion of the cathode surface takes part in actual current conducting. The concentration of the discharge current on this small portion of the cathode surface leads to excessive heating and evaporation of the oxide coating of the cathode causing the formation of a hot spot. This is detrimental to the maintenance (i.e., light output versus time) and results in phosphor darkening.

SUMMARY OF THE INVENTION

It is, therefore, an object of the present invention to obviate the disadvantages of the prior art.

It is still another object of the invention to provide an improved negative glow discharge lamp having improved lamp maintenance.

It is a further object of the invention to eliminate the need for an external ballast to limit lamp current.

To accomplish the foregoing and other objects, features and advantages of the invention there is provided a self-ballasted negative glow discharge lamp that is comprised of a light-transmitting envelope containing a gas fill material. A phosphor coating is disposed on the inner surface of the envelope. An anode is located within the envelope. An indirectly-heated cathode is located within the envelope for emitting electrons and includes a heater filament surrounded by a metallic cylinder having an emissive material thereon. The differential resistance of the heater filament is sufficient to ballast the negative glow discharge lamp. Lead-in wires are coupled to the cathode and anode and extend through and are hermetically sealed in the envelope.

Additional objects, advantages and novel features of the invention will be set forth in the description which follows, and in part will become apparent to those skilled in the art upon examination of the following or may be learned by practice of the invention. The aforementioned objects and advantages of the invention may be realized and attained by means of the instrumentalities and combination particularly pointed out in the appended claims.

BRIEF DESCRIPTION OF THE DRAWINGS

The invention will become more readily apparent from the following exemplary description in connection with the accompanying drawings, wherein.

BEST MODE FOR CARRYING OUT THE INVENTION

For a better understanding of the present invention, together with other and further objects, advantages and capabilities thereof, reference is made to the following disclosure and appended Claims in connection with the above-described drawings.

Figure 1:
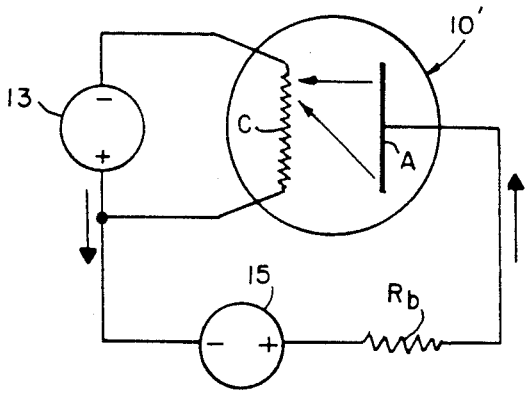
FIG. 1 PRIOR ART
FIG. 1 represents a schematic diagram of a circuit for starting and operating a negative glow discharge lamp of the prior art.
Figure 3:
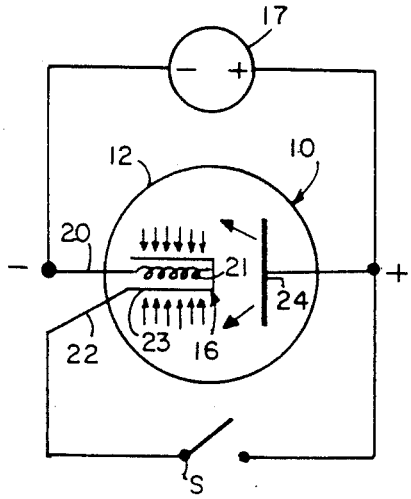
FIG. 3 represents a schematic diagram of a circuit for starting and operating a negative glow discharge lamp according to the present invention.
Figure 2:
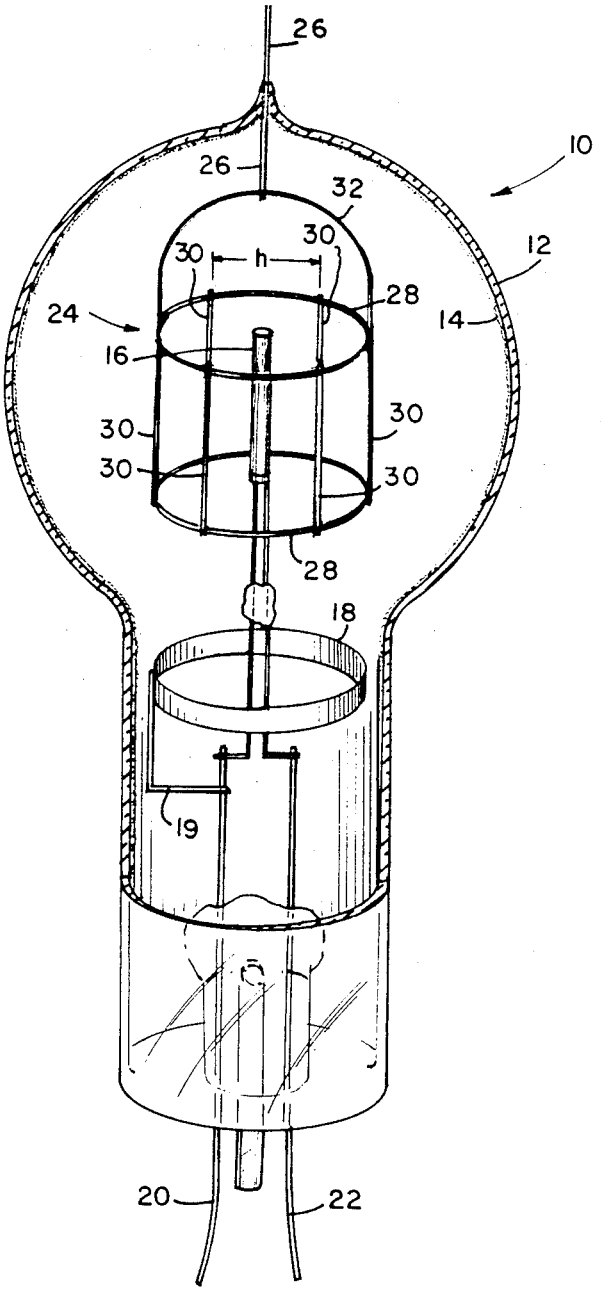
FIG. 2 represents a front elevational view, partially broken away, of an embodiment of a negative glow discharge lamp according to the present invention.

Referring now to the drawings with greater particularity, there is shown in FIGS. 2 and 3 a self-ballasted negative glow discharge lamp 10 having an envelope 12 containing an ionizable medium. The envelope may contain a noble gas or mixtures thereof at a low pressure, such as, 1–5 torr. The inner surface of the envelope is coated with phosphor coating 14. As stated, the spectral characteristics of the visible light is determined by the composition of the fluorescent powders used for the phosphor coating.

The envelope further contains a cathode 16 which in FIGS. 2 and 3 is in the form of an indirectly-heated cathode 16. Indirectly-heated cathode 16 includes a metallic cylinder 23 (FIG. 3) which is externally coated with an emissive material. The cylinder 23 surrounds a heater coil 21 (FIG. 3) which is coated with alumina. One end of heater coil 21 is electrically connected to metallic cylinder 23. Lead-in wires 20, 22 support the cathode 16 and provide current to the heater coil. The lead-in wires may be rod-like of say 20–30 mil diameter. Both of the lead-in wires 20, 22 are hermetically sealed at one end of lamp 10.

As illustrated in FIG. 2, glow lamp 10 may include a getter/mercury dispensing strip 18 which surrounds lead-in wires 20, 22 and is attached to lead-in wire 20 by means of conductor 19. One suitable material for strip 18 is ST101/505 manufactured by SAES Getters S.p.A, Milan, Italy.

According to the teachings of Ser. No. 07/329,135 filed concurrently herewith, an anode 24 is included within envelope 12 which during lamp operation does not attain a positive anode voltage drop (PAVD). The anode is constructed of a conductive material, such as wire, so that the anode will instead exhibit a zero or slightly negative voltage drop.

With particular attention to the embodiment illustrated in FIG. 2, preferably the anode 24 is in the form of a cylindrical wire cage coaxially surrounding cathode 16. Anode 24 includes a pair of circular wire rings 28 spaced apart and interconnected around the periphery of the ring 28 by six equally spaced transversing wire segments 30. Wire rings 28 lie in parallel planes perpendicular to the longitudinal axis of lamp 10 and the axis of the cathode. Alternatively, the wire anode 24 may be oriented so that the wire rings lie in planes parallel to the axis of the lamp.

Anode 24 is electrically connected to lead-in wire 26 by means of a U-shaped support rod 32. Support rod 32 can be constructed from the same wire as ring 28 and segments 30. Lead-in wire 26 is hermetically sealed in envelope 12 at an end opposite lead-in wires 20, 22.

Reference is now made herein to FIG. 3 which illustrates a schematic diagram of a circuit for starting and operating a negative glow discharge lamp having an indirectly heated cathode. Glow discharge lamp 10 includes wire anode 24 and an indirectly-heated cathode 16 which includes a heater filament 21. The positive side of a dc power source 17 is connected to anode 24 while the negative side of the source is connected to one end of heater filament 21. The other end of heater filament 21 is connected to metallic cylinder 23. A normally-open starter switch S is connected across lamp 10 in order to provide preheating to heater filament 21 during lamp starting. During lamp operation, current flows from anode 24 to the surface of metallic cylinder 23 and through heater filament 21 to power source 17. The differential resistance of heater filament 21 alone is sufficient to ballast the lamp.

Since the indirectly-heated cathode is equipotential, the discharge current distribution along its surface is generally homogeneous. This significantly reduces the probability of the formation of a hot spot.

The reason the heater filament can be used as an internal ballasting element is an opposite characteristics of the filament and the discharge differential resistances. For the discharge (including a glow lamp) differential resistance, $R_d = dV/dI$ is much smaller than the static one, $R_{st} = V/I$, thus requiring a ballast for stable operation. As to the filament, it has a differential resistance higher than its static resistance because of the temperature dependence of filament resistance. Thus the combination (series connection) of the filament and the discharge itself can make a device with a differential resistance close (or not much less) to the static one. That is the condition of the stable operation of this device. The fact that for filament where $R_d > R_{st}$ provide relative low power dissipation in this kind of a ballast.

Figure 4:
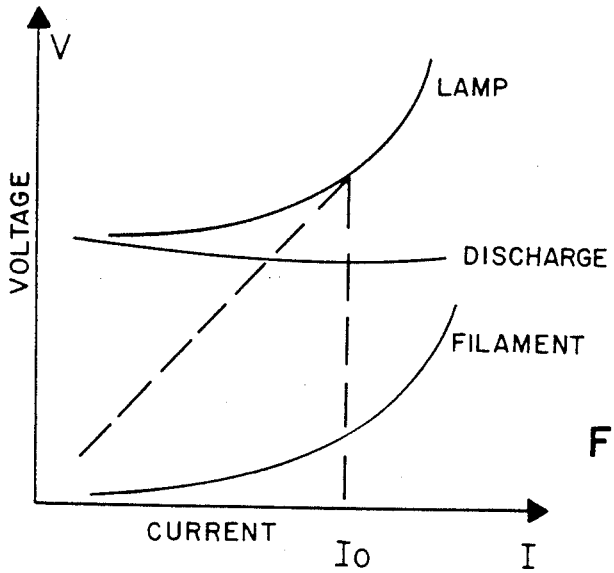
FIG. 4 represents the volt-ampere characteristics of the filament, negative glow discharge, and the lamp of the present invention operating on the circuit of FIG. 3.

The diagram in FIG. 4 shows the volt-ampere characteristics of a self-ballasted negative glow discharge lamp with an indirectly-heated cathode. As shown in FIG. 4, for an operational current point $I = I_o$, the differential resistance (i.e., $R_d$) is equal to approximately the static resistance (i.e., $R_{st}$). The voltage across the filament is only $\frac{1}{4}$ of the total voltage and consequently only 25% of the total lamp power is dissipated by the filament ballast. The filament resistance is designed to provide necessary filament power for rated discharge current.

By using a indirectly-heated cathode, it is possible to measure the discharge and the filament power separately. In the discharge with directly-heated filament cathode, it is extremely difficult or impossible.

In a typical but non-limitative example of a negative glow discharge lamp in accordance with the teachings of the present invention, the anode is in the form of a cylindrical wire cage coaxially surrounding the cathode and includes two spaced apart wire rings each having a diameter of 1.0 inch (2.54 centimeter). The wire rings are interconnected by six transversing wire segments each having a length of 1.0 inch. The distance h between adjoining pairs of wire segments (and also the average cell distance) is about 0.5 inch (1.27 centimeters). The orientation of the cathode and wire cage anode is as illustrated in FIG. 2. The radius thickness of the wire used for the wire rings and segments is 0.25 millimeter. The cathode was an indirectly-heated type KL 286 (6X5) manufactured by Philips ECG Incorporated.

There has thus been shown and described an improved negative glow discharge lamp. The invention provides a negative glow discharge lamp having an indirectly-heated cathode. The resistance of the filament heater of the cathode is sufficient to ballast the lamp.

While there have been shown and described what are at present considered to be the preferred embodiments of the invention, it will be apparent to those skilled in the art that various changes and modifications can be made herein without departing from the scope of the invention. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A self-ballasted negative glow discharge lamp comprising:

a light-transmitting envelope containing a gas fill material;

a phosphor coating disposed on the inner surface of said envelope;

an anode located within said envelope;

an indirectly-heated cathode located within said envelope for emitting electrons, said indirectly-heated cathode including a heater filament surrounded by a metallic cylinder coated with an emissive material, said heater filament connected in series with the discharge so that discharge current flows therethrough, said heater filament having a resistance sufficient by itself to ballast said negative glow discharge lamp; and lead-in wires coupled to said cathode and anode extending through and hermetically sealed in said envelope.

2. The negative glow discharge lamp as set forth in claim 1 wherein said anode is in the form of a cylindrical wire cage surrounding said indirectly-heated cathode.

3. The negative glow discharge lamp as set forth in claim 1 wherein said fill material includes neon at a pressure of 2 torr.

4. A negative glow discharge lamp system comprising:

a glow discharge lap including a light-transmitting envelope containing a gas fill material, a phosphor coating disposed on the inner surface of said envelope, an anode located within said envelope, an indirectly-heated cathode located within said envelope for emitting electrons, said indirectly-heated cathode including a heater filament surrounded by a metallic cylinder coated with an emissive material, said heater filament connected in series with the discharge so that discharge current flows therethrough, said heater filament having a resistance sufficient by itself to ballast said negative glow discharge lamp, and lead-in wires coupled to said cathode and anode extending through and hermetically sealed in said envelope;

a dc power source having a positive and negative terminal, said positive terminal connected to said anode and said negative terminal connected to one end of said heater filament; and a starter means shunting said lamp.

5. The glow discharge lamp system as set forth claim 4 wherein said starter means is a glow discharge starter.

* * * * *